US005857838A

United States Patent [19]

Wagner, Jr.

[11] Patent Number: 5,857,838

[45] Date of Patent: Jan. 12, 1999

[54] WATER COOLED STEAM JET

[75] Inventor: Edward P. Wagner, Jr., Idaho Falls, Id.

[73] Assignee: Lockheed Martin Idaho Technologies Company, Idaho Falls, Id.

[21] Appl. No.: 832,679

[22] Filed: Apr. 9, 1997

[51] Int. Cl.[6] ..... F04F 5/00

[52] U.S. Cl. ..... 417/173; 417/54; 417/198

[58] Field of Search ..... 417/173, 54, 198

[56] References Cited

U.S. PATENT DOCUMENTS

| | | | |
|---|---|---|---|
| 1,529,774 | 3/1925 | Delas | 417/54 |
| 3,456,871 | 7/1969 | Gosling | 417/54 |
| 3,711,596 | 1/1973 | Hartig . | |
| 4,280,796 | 7/1981 | Reinsch | 417/173 |
| 4,375,386 | 3/1983 | Windham . | |
| 4,576,008 | 3/1986 | Silvestri, Jr. . | |

FOREIGN PATENT DOCUMENTS

| | | | |
|---|---|---|---|
| 554698 | 6/1923 | France | 417/173 |

OTHER PUBLICATIONS

Water Jet Exhausters and Compressors, Schutte & Koerting Co., Bulletin No. 4–P, pp. 4401–4414. Aug. 1934.

*Primary Examiner*—Timothy Thorpe
*Assistant Examiner*—Cheryl J. Tyler
*Attorney, Agent, or Firm*—Thorpe North & Western

[57] ABSTRACT

A water cooled steam jet for transferring fluid and preventing vapor lock, or vaporization of the fluid being transferred, has a venturi nozzle and a cooling jacket. The venturi nozzle produces a high velocity flow which creates a vacuum to draw fluid from a source of fluid. The venturi nozzle has a converging section connected to a source of steam, a diffuser section attached to an outlet and a throat portion disposed therebetween. The cooling jacket surrounds the venturi nozzle and a suction tube through which the fluid is being drawn into the venturi nozzle. Coolant flows through the cooling jacket. The cooling jacket dissipates heat generated by the venturi nozzle to prevent vapor lock.

5 Claims, 2 Drawing Sheets

WATER COOLED STEAM JET

CONTRACTUAL ORIGIN

The United States Government has rights in this invention disclosed under contract number DE-AC07-84ID12435 between the U.S. Department of Energy and Westinghouse Idaho Nuclear Company, now contract number DE-AC07-94ID13223 with Lockheed Idaho Technologies Company.

BACKGROUND OF THE INVENTION

1. Field of the Invention

This invention relates to a steam jet for fluid transfer applications, and more particularly to a steam jet that is cooled to prevent vaporization of the fluid being transferred as it is drawn into the steam jet.

2. Relevant Technology

There is an important need for moving contaminated fluids in nuclear reactors and other hazardous waste locations. One well known and acceptable mechanism for moving such fluid is what is commonly called a "steam jet." In a steam jet, steam passes through a venturi nozzle and discharges out one end. As the steam passes through the venturi nozzle, a vacuum is created which is communicated to the fluid that is to be displaced. The vacuum draws the fluid that is to be moved into the venturi nozzle.

Steam jets are particularly useful in the instances where the fluid is destructive to moving parts, corrosive, or is a hazardous/toxic material that presents a danger should it be sprayed or be dispersed. For example, steam jets are often used in applications where the fluid to be transferred may be a contaminated fluid in a nuclear reactor or may be a fluid filled with corrosive materials and/or hazardous components. In addition to the problems created by moving parts, traditional pumps that spray or otherwise disperse toxic materials are undesirable. An example of where steam jets are commonly used is in a chemical plant. Among the advantages of the steam jet are that it can be used to move very hazardous fluids, does not substantially dilute the hazardous fluid or contaminated material, and does not involve moving parts. An example of a particularly hazardous application is the ability of the steam jet to be utilized in nuclear reactors and nuclear processes facilities to move solutions of recovered fissile materials and radioactive waste. An additional and often key benefit of the steam jet that is specifically a result of the elimination of any moving parts is that a steam jet requires little maintenance. The reduced maintenance minimizes the potential contact with the hazardous or contaminated fluid.

Transporting fluids utilizing a steam jet, however, does have a serious drawback when the fluid that is to be transferred vaporizes at or below the temperature of steam. In these circumstances, the heat in the steam jet vaporizes the contaminated or hazardous fluid that is being drawn into the steam jet by the vacuum and creates what is called "vapor lock." Once a vapor lock occurs, a long delay is experienced until the heat in the steam jet dissipates sufficiently, and the steam jet is cool enough to attempt another transfer. A delay may cause an entire system to shut down. Any time the system is slowed down or shut down, it is costly as well as presenting a serious potential hazard. In addition, high temperatures are hard on equipment and can cause premature fatigue of the steam jet and pipes attached thereto.

SUMMARY AND OBJECTS OF THE INVENTION

It is an object of the present invention to provide a steam jet for moving hazardous fluids that is cooled to prevent vaporization of a hazardous fluid that is being drawn into the steam jet.

It is another object of the present invention to provide a steam jet that safely transports hazardous fluids without overheating and experiencing "vapor lock."

It is a further object of the present invention to provide a steam jet for transferring hazardous fluids that will not cause a system shut down.

It is another object of the present invention to provide a steam jet that in the event a shut down occurs due to a vapor lock caused by unforeseen circumstances is capable of minimizing the time the system is incapacitated.

Another object of the present invention is to provide a method for preventing vapor lock when transferring contaminated or hazardous fluids.

Additional objects and advantages of the invention will be set forth in a description which follows, and in part will be obvious from the description, or may be learned by the practice of the invention. The objects and advantages of the invention may be realized and obtained by means of the instruments and combinations particularly pointed out in the appended claims.

To achieve the foregoing objects, and in accordance with the invention as embodied and broadly described herein, a water cooled steam jet for transferring fluid is provided that comprises a steam jet and a cooling means. The steam jet produces a high velocity flow capable of creating a vacuum to draw fluid into the source of fluid to be transferred. The steam jet has a steam inlet and outlet. The steam jet comprises a venturi nozzle with a converging section, a diffuser section, and a throat portion disposed therebetween. The converging section of the venturi nozzle is connected to a source of steam. The throat portion of the venturi nozzle has a high velocity flow.

The cooling means comprises a cooling jacket that cools the steam jet and suction tube through which contaminated fluid is being drawn into the steam jet to prevent vaporization of the fluid being transferred as it is being drawn into the steam jet. The cooling jacket surrounds the steam jet and has a coolant inlet and a coolant outlet. The cooling jacket has an inlet connected to a source of coolant and an outlet allowing the coolant to flow through the cooling jacket, thereby cooling the steam jet. The coolant comprises water.

A method for preventing vapor lock when transferring fluids is also provided herein. A venturi nozzle is provided for producing a high velocity flow capable of creating a vacuum to draw the fluid from a source of fluid to be transferred into the venturi nozzle. A cooling jacket is provided that surrounds the venturi nozzle for cooling the venturi nozzle and the suction tube through which contaminated fluid is being drawn into the venturi nozzle to prevent vaporization of the fluid being transferred as the fluid is being drawn into the venturi nozzle. Activating the cooling jacket allows the coolant to flow around the venturi nozzle. The venturi nozzle is now activated which causes high velocity flow creates a vacuum to drawn the fluid to be transferred into the venturi nozzle.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawing depict only a typical embodiment of the invention and are not therefore to be considered to be limiting of its scope, the invention will be described and explained with additional specificity and detail through the use of the accompanying drawings in which:

FIG. 2 is diagrammic representation of the water cooled steam jet and the system that steam jet operates in conjunction with.

DETAILED DESCRIPTION OF THE PREFERRED EMBODIMENTS

Figure 1:
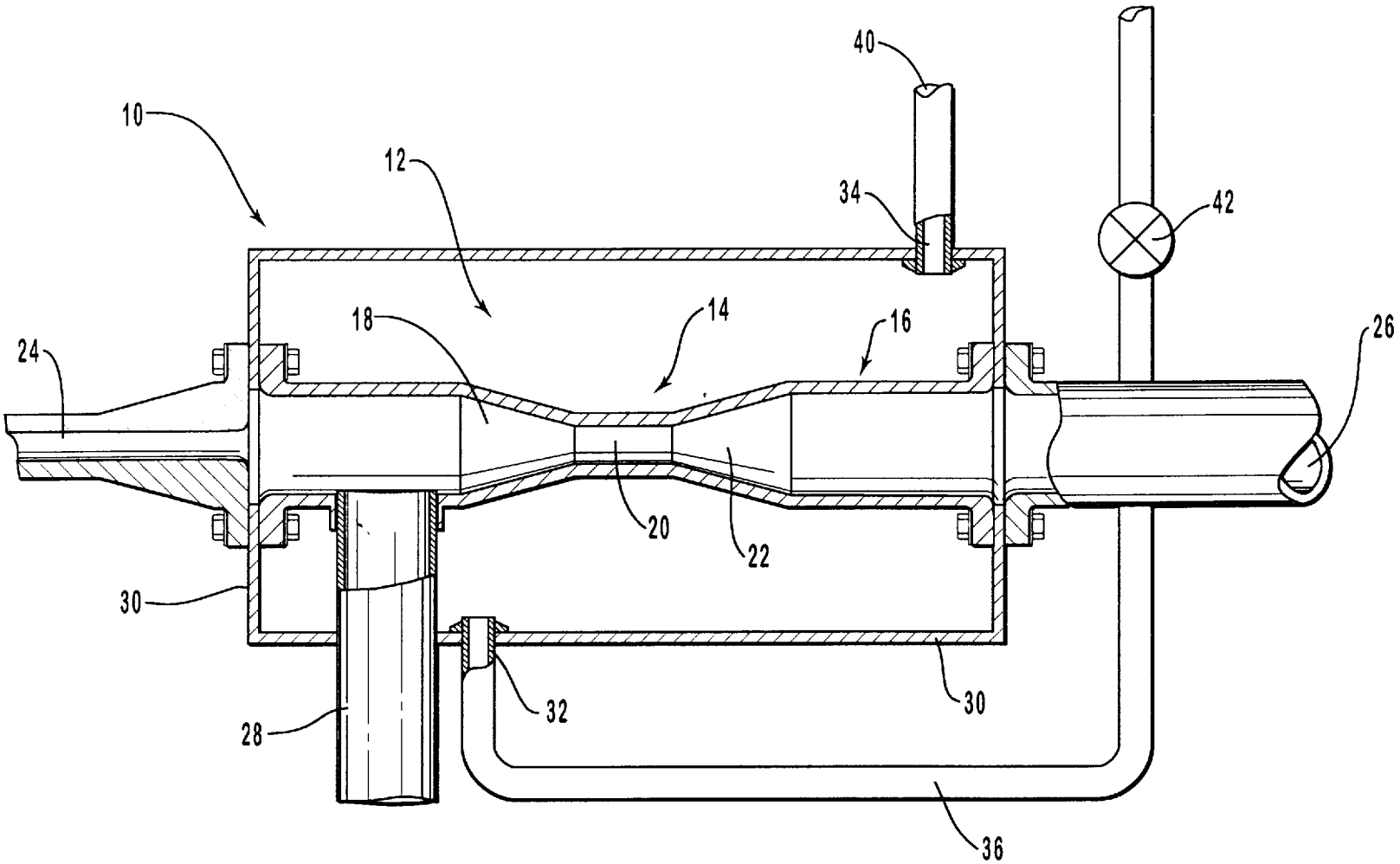
FIG. 1 is a cross-sectional elevation view of the water cooled steam jet.

The present invention relates to a water cooled steam jet 10 that is to be used in fluid transfer applications. One embodiment of the inventive water cooled steam jet 10, as shown by way of example and not limitation in FIG. 1, comprises a steam jet that is shown generally as 12 and includes a venturi nozzle 14. Venturi nozzle 14 is formed by a housing 16 that has a converging section 18, a throat portion 20, and a diffuser section 22. Throat portion 20 is located between converging section 18 and diffuser section 22. Steam jet 12 comprising venturi nozzle 14 is one example of structure capable of performing the function of a steam jet means for producing a high velocity flow capable of creating a vacuum to draw fluid from a source of the fluid to be transferred.

A steam inlet 24 is connected with converging section 18 of nozzle 14. Suction tube 28 is also connected to converging section 18 of nozzle 14 and enables steam jet 12 to be in communication with the source of the fluid that is to be transferred. Outlet 26 is connected to diffuser section 22 of venturi nozzle 14.

Throat portion 20 is a constriction in venturi nozzle 14 that results in an increased velocity, and, consequently, an increase in kinetic energy in throat portion 20. This causes a corresponding reduction in pressure. Therefore, throat portion 20 has a high velocity flow. The high velocity flow through throat portion 20 and reduced pressure through diffuser section 22 produces self-sustaining low pressure generation for both steam jet 12 operation and the development of a vacuum which creates suction to draw the fluid to be transferred into converging section 18 of steam jet 12 through suction tube 28. The combined flow of the steam and the fluid to be transferred pass from converging section 18 into throat portion 20 and then into diffuser section 22. In one embodiment of water cooled steam jet 10 illustrated in FIG. 1, suction tube 28 and outlet 26 have substantially the same diameter.

Water cooled steam jet 10 also comprises an inventive cooling jacket 30 that surrounds steam jet 12. Cooling jacket 30 has a coolant inlet 32 and a coolant outlet 34. Cooling jacket 30 may be fabricated from metal compatible with steam jet 12. Alteratively, cooling jacket 30 may be a casting that is attached to steam jet 12 or that is integrally formed with steam jet 12 as one casting. Cooling jacket 30 may comprise various other materials without effecting the function thereof as long as it may be securely attached to either steam jet 12 or any pipes connected thereto and can withstand the environment that steam jet 12 operates in. Cooling jacket 30 is attached to steam jet 12 or piping attached thereto by a conventional attachment method including seal welding. Cooling jacket 30 is one example of a cooling means for cooling steam jet means, such as steam jet 12, to prevent vaporization of the fluid being transferred.

Coolant inlet 32 is connected to a coolant supply line 36 that includes a valve 42 capable of regulating the flow of coolant into cooling jacket 30. An example of such a valve is a globe valve. Coolant outlet 34 is attached to a coolant outlet pipe 40. Coolant supply line 36 delivers a coolant, such as water, to cooling jacket 30. Other types of coolant are equally effective in carrying out the intended function thereof.

In one embodiment of water cooled steam jet 10 as illustrated in FIG. 1, coolant inlet 32, coolant outlet 34, and steam inlet 24 are all the same size. Connections between coolant supply line 36 and coolant inlet 32 as well as coolant outlet 34 and coolant outlet pipe 40 may be by screws, welds, flanged pipe or tubing compression fittings, as needed for compatibility with the particular use. Coolant outlet pipe 40 can be connected to coolant supply line 36 to form a closed coolant loop. If a closed coolant loop is desirable, some means for removing the heat that the coolant picks up as it goes through cooling jacket 30 must be incorporated into the scheme. A heat exchanger, for example, can be utilized in such a closed coolant loop. Alternatively, the coolant loop may be an open coolant loop particularly where the coolant is water and there is a plentiful supply of low cost water. Either configuration of the coolant supply loop is equally effective in performing the function thereof.

Figure 2:
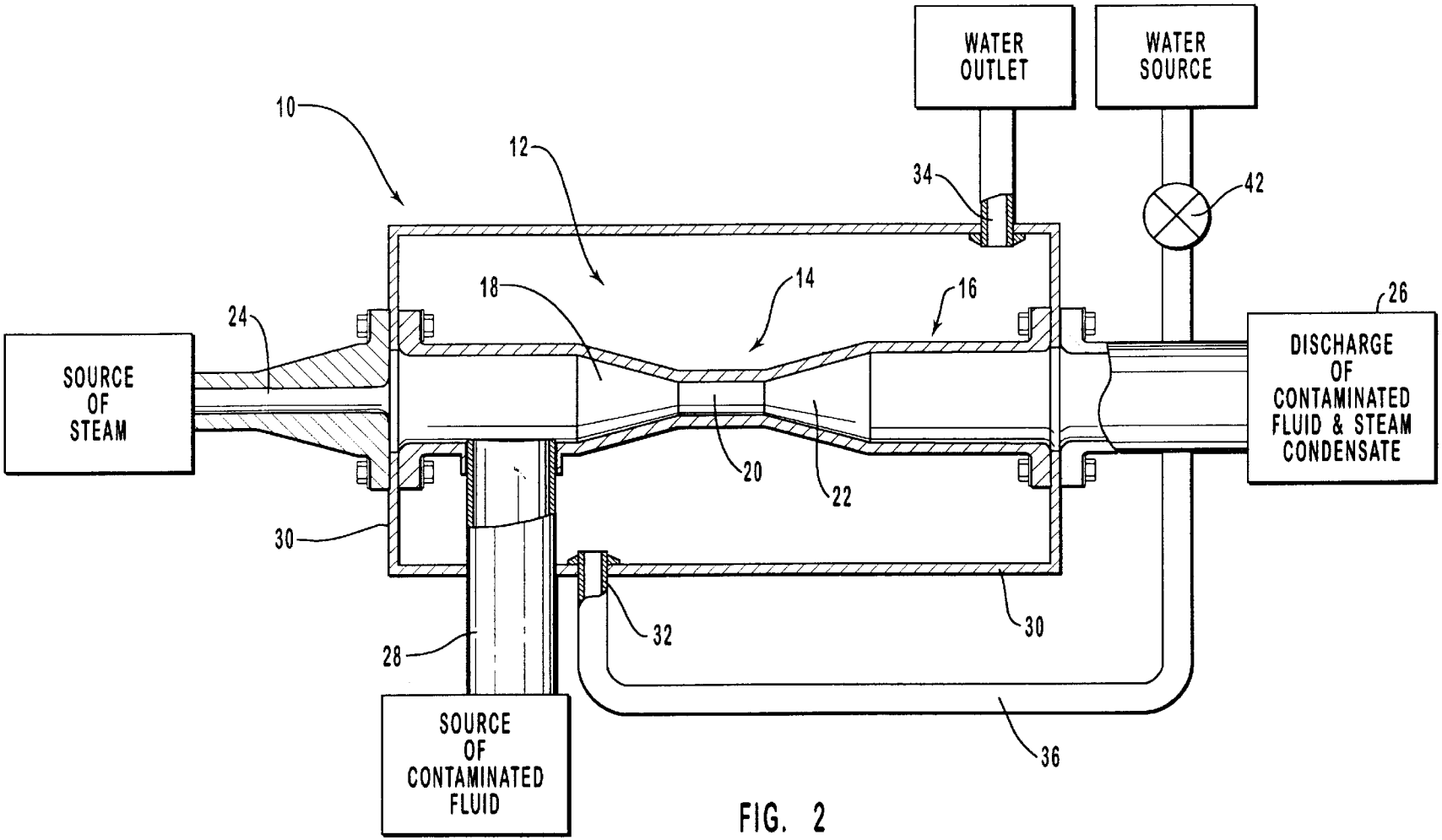

In use, coolant flow through cooling jacket 30 is started prior to the application of steam to steam jet 12. As illustrated in FIG. 2, steam from a source of steam enters the steam jet 12 through steam inlet 24. As the steam moves through venturi nozzle 14 a vacuum is created in suction tube 28. The vacuum results in a suction column being formed in suction tube 28 which in turn draws the fluid to be transferred from the source of the fluid into steam jet 12. Contaminated fluid and steam condensate are discharged through outlet 26.

Cooling jacket 30 allows steam jet 12 to be utilized continuously over long periods of time in fluid transfer applications without the problem of over heating above the vaporization point of the fluid being transferred and causing vapor lock. Once the transfer of the fluid to be moved is established, the coolant flow may be reduced by adjusting valve 42 in coolant supply line 36.

In the rare occasion of an unexpected interruption of coolant flow through cooling jacket 30 that results in a vapor lock due to the fluid that is being transferred vaporizing in suction tube 28 from the heat of steam jet 12, a restart of coolant flow through cooling jacket 30 significantly reduces the time required to dissipate the heat and reduce the temperature in steam jet 12 so that the transfer of the fluid can be reinitiated.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

I claim:

1. A cooled steam jet for transferring fluid comprising:

a. a source of fluid to be transferred;

b. a source of steam;

c. a venturi nozzle comprising a convergent section, a diffuser section, and a throat portion disposed therebetween, said venturi nozzle being capable of producing a high velocity flow capable of creating a vacuum to draw the fluid from said source of the fluid to be transferred, said venturi nozzle being connected to said source of steam, said throat portion having a high velocity flow; and d. a cooling jacked disposed around said throat portion and said converging and diffuser sections of said veneturi nozzle, said cooling jacket having an inlet connected to said source of coolant and an outlet allowing said coolant to flow through said cooling jacket, thereby cooling said venturi nozzle to prevent vaporization of the fluid being transferred as the fluid is being drawn into said venturi nozzle.

2. A cooled steam jet as recited in claim 1, wherein said coolant comprises water.

3. A method for preventing vapor lock when transferring fluids, said method comprising the steps of:

a. providing a venturi nozzle for producing a high velocity flow capable of creating a vacuum to draw the fluid from a source of the fluid to be transferred, said venturi nozzle comprising a converging section, a diffuser section, and a throat portion disposed therebetween, said venturi nozzle being connected to a source of steam, said throat portion having a high velocity flow;

b. providing a cooling jacket disposed around said throat portion and said converging and diffuser sections of said venturi nozzle, said cooling jacket having an inlet connected to a source of coolant and an outlet capable of allowing said coolant to flow through said cooling jacket, thereby cooling said venturi nozzle to prevent vaporization of the fluid being transferred as the fluid is being drawn into said venturi nozzle;

c. connecting said cooling jacket to said source of a coolant;

d. activating said cooling jacket, thereby allowing said coolant to flow around said cooling jacket; and e. activating said venturi nozzle whereby said high velocity flow creates a vacuum to draw the fluid to be transferred into said venturi nozzle while said cooling jacket dissipates the heat generated by said venturi nozzle and prevents vapor lock.

4. A method for preventing vapor lock when transferring fluids as recited in claim 3, wherein said coolant comprises water.

5. A cooled steam jet for transferring a fluid comprising:

a. steam jet means for producing a high velocity flow capable of creating a vacuum to draw the fluid from a source of the fluid to be transferred, said steam jet means having a steam inlet and an outlet, said steam jet means being in communication with said source of the fluid to be transferred;

b. a suction tube through which the fluid is drawn; and c. cooling means, surrounding said steam jet means and a portion of the suction tube, for cooling said steam jet means to prevent vaporization of the fluid being transferred as the fluid is being drawn into said steam jet means.

* * * * *